United States Patent [19]

Büng et al.

[11] Patent Number: 4,534,720

[45] Date of Patent: Aug. 13, 1985

[54] APPARATUS FOR THE PREPARATION OF BONDING FIBERS FROM POLYMER DISPERSIONS

[75] Inventors: Richard Büng; Karl Gans; Gerold Schreyer, all of Ludwigshafen; Gerhard Welzel, Mannheim, all of Fed. Rep. of Germany

[73] Assignee: BASF Aktiengesellschaft, Fed. Rep. of Germany

[21] Appl. No.: 400,045

[22] Filed: Jul. 20, 1982

[30] Foreign Application Priority Data

Jul. 22, 1981 [DE] Fed. Rep. of Germany ..... 3128873

[51] Int. Cl.[3] ..... B22F 9/00

[52] U.S. Cl. ..... 425/7

[58] Field of Search ..... 425/7, 10

[56] References Cited

U.S. PATENT DOCUMENTS 4,211,737 7/1980 Dyusco et al. ..... 425/7

*Primary Examiner*—James R. Hall

*Attorney, Agent, or Firm*—Keil & Weinkauf

[57] ABSTRACT

An apparatus for the preparation of bonding fibers, especially for the production of nonwovens by a wet-lay process, wherein a polymer dispersion, containing an anionic or nonionic dispersant, and an aqueous solution, containing a dissolved cationic precipitant, are combined to cause fiber formation from precipitated polymer particles, which apparatus includes a feed funnel spaced above the bottom of a homogenization vessel with both a nozzle for introducing the polymer dispersion and a metering device for the precipitant, which are so arranged and aimed into the funnel that in co-operation with a stirrer a vortex is produced in a column of liquid in the feed funnel, and fibers are formed and broken up while passing through a turbulence chamber, located at the bottom of the funnel, and a gap into a homogenization chamber.

3 Claims, 1 Drawing Figure

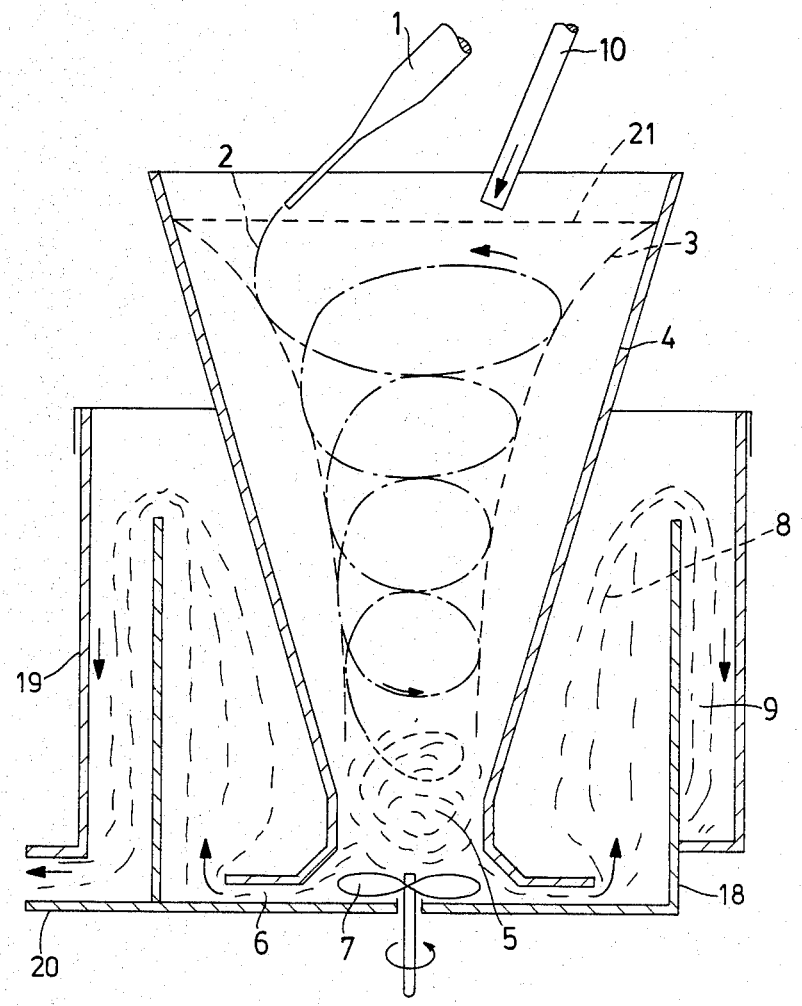
1
10
21
2
3
4
8
19
9
18
20
6
7
5

APPARATUS FOR THE PREPARATION OF BONDING FIBERS FROM POLYMER DISPERSIONS

The present invention relates to an apparatus for the preparation of bonding fibers, especially bonding fibers useful for the production of nonwovens by a wet-lay process, comprising means for combining a polymer dispersion, containing an anionic or nonionic dispersant, and an aqueous solution, containing a dissolved cationic precipitant, and causing polymer particles to precipitate and form fibers.

A number of processes for the preparation of bonding fibers are known. According to U.S. Pat. No. 2,988,782 and numerous subsequent publications, especially German Published Application No. DAS 2,326,143, polymers are dissolved in a solvent and the resulting solutions are precipitated, in a non-solvent for the polymer, under the action of shearing forces, whereby the precipitated polymer particles are fibrillated. This results—in particular if very special conditions taught by German Published Application No. DAS 2,326,143 are observed—in very short thin fibers, also referred to conventionally as fibrids. Such fibrids can be used directly for the production of, for example, special synthetic papers. However, such fibrids are not always suitable for bonding nonwoven fibrous materials, for which bonding fibers are required, since the structure of the fibrids is too short and too highly branched. For bonding, longer and thinner fibers are required.

German Published Application No. DAS 2,159,871 discloses that certain anionic polymer dispersions can be converted to longer bonding fibers if such a dispersion is introduced, as a thin jet, into an aqueous cationic polymer solution, resulting in fibrous precipitation of the polymer particles. According to this publication, it is necessary to use an anionically dispersed polymer which has a glass transition temperature of from +25° C. to −52° C. These conditions, however, lead to very short fibers or, more accurately, fibrids, whose length is stated, in Example 1 of the last-mentioned publication, to be at most 500 μm.

Hitherto, bonding fibers or fibrids for bonding nonwovens have always been prepared from a polymer dispersion or solution by precipitation with a precipitation fluid under high shearing stresses. For example, U.S. Pat. No. 2,999,788 proposes effecting the precipitation in a kettle with vigorous stirring, or by injection at a high relative velocity of the precipitation fluid. German Laid-Open Application No. DOS 1,660,628 describes effecting the precipitation after the dispersion has issued from a capillary into a turbulent precipitation bath which flows directly past the capillary. Swiss Pat. No. 487,672 describes a precipitation apparatus in which vigorous shearing is generated by means of rotors and shearing blades. In the process of German Laid-Open Application No. DOS 2,159,871, the polymer dispersion is injected as a thin jet, under pressure, through a narrow nozzle into a moderately stirred precipitation bath; the process requires the polymer to have a particular glass transition temperature (Tg). According to German Laid-Open Application No. DOS 2,326,143 fibrids are produced by precipitation in a shearing zone which is generated by means of nozzles and in which the individual jets have velocities of not less than 5 m/s. Finally, German Laid-Open Application No. DOS 2,516,561 also describes precipitation in a shearing zone, the mean energy density being not less than 5 W.sec/cm$^3$.

In all these cases, coagulation in the shearing zone produces only very small or short fibrids or bonding fibers; even in the method of German Laid-Open Application No. DOS 2,159,871, the bonding fibers are at most 0.5 mm long.

It is an object of the present invention to provide an apparatus whereby polymer dispersions of diverse chemical origin can be converted, in a simple manner, either to fibrids or to thin fibers, not less than 1 mm long, which are useful as fibers for bonding nonwovens. The reason for the minimum length is that smaller bonding fibers can, when the nonwoven material web is drained, pass into the filtrate, settle out in the water circuit and cause problems; moreover, they are lost as binders for the nonwoven.

This object is achieved by an apparatus of the type first mentioned and as shown in cross-section in the accompanying drawing, wherein, according to the invention, (a) a nozzle for introducing the polymer dispersion into a feed funnel and a metering device for the precipitant are so arranged that in co-operation with a stirrer a vortex is produced in the feed funnel, and (b) a turbulence chamber is located between the stirrer and the feed funnel, and opens, via a gap, into a homogenization chamber.

Preferably, a discharge chamber is provided downstream of the homogenization chamber.

The advantages achieved by means of the invention are, in particular, that bonding fibers or fibrids, having a length of from 1 to 6 mm or even greater, can be produced in a precipitation bath in laminar flow, with low shearing forces.

The apparatus of the invention is described in more detail below with reference to the drawing wherein it is shown in cross-section to comprise an inwardly tapering, funnel 4 the wall of which extends above a homogenization vessel 18 and a discharge vessel 19 having a discharge port 20, at the bottom thereof, positioned to receive and contain overflow from the homogenization vessel 18. A nozzle 1 and a liquid metering device 10 are positioned above the funnel 4 and aimed at an angle therein.

By means of a stirrer 7, located at the bottom of the funnel 4, and the aqueous solution containing a dissolved precipitant flowing from a supply thereof (not shown) in through a metering device 10, a vortex 3 is produced in a rotating column of liquid maintained to a level designated by the reference number 21, the feed funnel 4; and the liquid will flow outwardly from the bottom of the funnel 4 to produce a rotating precipitation bath in a homogenization chamber 8 of the homogenization vessel 18. The polymer dispersion is introduced in a thin jet, from a supply thereof through the nozzle 1, in the direction of rotation of the vortex 3. The dispersion thread 2 which is formed migrates spirally downwards in the vortex 3. In the course thereof, the surface of the thread is at least partially fixed by coagulation of the thread-like dispersion. The column of liquid flows downwardly through the funnel 4 and a turbulence chamber 5 at the bottom thereof and through a milling gap 6, extending between the bottom of chamber 5 and the bottom wall of homogenization vessel 18, where the coagulated thread of dispersion is broken up into bonding fibers or fibrids. Such fibers and liquid thence flow into a homogenization chamber 8, within vessel 18 as a rotating overflowing precipitation bath, whereupon the fibers or fibrids formed are fixed by final coagulation and transported in the liquid into a discharge chamber 9 within vessel 19. Depending on the speed of rotation and shape of the stirrer 7, the pressure in the nozzle 1 and the width of the gap 6, fibers of different lengths, or fibrids, are produced, having varying degrees of branching at the surface and at the ends.

Such fibers or fibrids are thence carried in the liquid out discharge port 20 and conveyed to apparatus (not shown) to carry out a wet lay process where the fibers and fibrids are deposited as a nonwoven felt.

We claim:

1. Apparatus for the preparation of bonding fibers, especially for the production of nonwoven materials by a wet-lay process, comprising means for combining a polymer dispersion, containing an anionic or nonionic dispersant, and an aqueous solution, containing a dissolved cationic precipitant and causing fiber formation from precipitated polymer particles, which apparatus comprises: a feed funnel for maintaining a column of liquid, a nozzle for introducing the polymer dispersion into said feed funnel and a metering device for the precipitant, which are aimed at an angle into the feed funnel, and a homogenization chamber connected to the feed funnel via a gap, and thence to a discharge chamber having a discharge port, whereby a vortex is produced in the said funnel and a dispersion thread of polymer forms therein and is broken into fiber lengths as the liquid and thread flow from the funnel to said homogenization chamber.

2. Apparatus as claimed in claim 1, wherein a discharge chamber is provided downstream of the homogenization chamber.

3. Apparatus as claimed in claim 1, including a turbulence chamber at the bottom of said funnel which turbulence chamber is connected to said homogenization chamber by a milling gap, and a stirrer means at the bottom of said turbulence chamber which stirrer means assists in producing the vortex and imparts a rotary motion to fluid in the funnel and flowing outwardly through said milling gap.

* * * * *